US007854621B2

(12) United States Patent
Poulsen

(10) Patent No.: US 7,854,621 B2
(45) Date of Patent: Dec. 21, 2010

(54) TOUCH-SAFE SOCKET

(75) Inventor: Carsten H. Poulsen, Skive (DK)

(73) Assignee: Insalvo Denmark APS, Skive (DK)

( * ) Notice: Subject to any disclaimer, the term of this patent is extended or adjusted under 35 U.S.C. 154(b) by 143 days.

(21) Appl. No.: 12/085,044

(22) PCT Filed: Nov. 14, 2006

(86) PCT No.: PCT/DK2006/000629

§ 371 (c)(1),
(2), (4) Date: Jun. 10, 2008

(87) PCT Pub. No.: WO2007/057010

PCT Pub. Date: May 24, 2007

(65) Prior Publication Data

US 2009/0269961 A1 Oct. 29, 2009

(30) Foreign Application Priority Data

Nov. 15, 2005 (DK) ..... 2005 01590

(51) Int. Cl.
*H01R 13/625* (2006.01)
*H01R 4/50* (2006.01)

(52) U.S. Cl. ..... 439/340; 439/666; 439/339; 439/188; 439/419; 439/700

(58) Field of Classification Search ..... 439/340, 439/338, 339, 188, 700, 666, 667, 842, 419
See application file for complete search history.

(56) References Cited

U.S. PATENT DOCUMENTS

| | | | | |
|---|---|---|---|---|
| 6,036,522 | A * | 3/2000 | Holzer | 439/306 |
| 6,491,534 | B1 | 12/2002 | Bonard et al. | 439/188 |
| 2009/0029583 | A1 * | 1/2009 | Poulsen | 439/306 |

FOREIGN PATENT DOCUMENTS

| | | |
|---|---|---|
| DE | 1539415 | 10/1969 |

* cited by examiner

*Primary Examiner*—Javaid Nasri
(74) *Attorney, Agent, or Firm*—Dykema Gossett PLLC

(57) ABSTRACT

A touch-safe socket for electrical articles, such as bulbs having threads, is provided with a movable carriage-carrying poles which are connected to an electrical supply via a wire. The movable carriage has threads which cooperate with threads on the electrical article, and when the electrical article is screwed into the movable carriage, the movement will cause the poles to make contact with poles which are secured to a stationary plate. Further, a movable bridge having poles is arranged inside the socket, which, when the electrical article is screwed in, will be moved into the socket and also make contact with the poles on the stationary plate.

9 Claims, 1 Drawing Sheet

TOUCH-SAFE SOCKET

BACKGROUND OF THE INVENTION

FIELD OF INVENTION

The invention relates to a touch-safe socket for electrical articles, such as bulbs, having poles, wherein at least two poles connected to an electrical supply are mounted inside the socket, and wherein the socket is provided with movable means to protect against touch of the poles of the socket, the movable means being affected during the insertion of the electrical article into the socket, and wherein the movable means are formed by a movable carriage which carries the poles, and wherein the movement is provided by the insertion of the bulb into the socket so that the poles make contact with two poles which are secured to a stationary plate, whose poles extend through the stationary plate.

THE PRIOR ART

U.S. Pat. No. 6,491,534 discloses a touch-safe socket, where, When a bulb is screwed into the socket, a spring-biased disc, which has electrical terminals, can move the terminals of the disc down against current-carrying poles at the bottom of the socket and thereby provide voltage to the bulb.

In another embodiment according to the US patent, the movable parts are formed by spring-biased push-buttons configured as switches which are arranged in the threads of the socket, so that the switches, when the bulb is screwed into the threads, will press the push-buttons home and thereby provide electric voltage to the bulb.

An embodiment including both safety systems is also described.

In the known structure, it will be relatively easy for a person to press the disc and/or the push-buttons with the fingers and thereby connect voltage to the fingers, causing electric shock.

Further, DE Offenlegungsschrift No. 1 539 415 discloses a touch-safe socket. A drawback of this known socket is that electrical contact to the poles of the socket may be made by a pull of the threads of the socket.

Accordingly, an object of the invention is to provide a touch-safe socket for electrical articles, such as bulbs, where it is practically impossible to get an electric shock if a person's fingers are moved into the socket.

SUMMARY OF THE INVENTION

The object of the invention is achieved by a touch-safe socket, wherein when being inserted into the socket, the poles of an electrical article touch poles which are arranged on a movable bridge, the poles extending through the bridge so that, when being moved, the poles of the bridge make contact with the poles on the stationary plate.

Hereby, a pull of the threads of the socket cannot result in electrical contact with the free poles of the socket, it being required that also the movable bridge is to be pressed into the socket before electrical contact can be made.

For safe control of the movable bridge it is advantageous if the movable bridge is spring-biased.

It is a further characteristic of the invention, that, when being moved into the socket, the electrical article first moves the movable bridge into the socket, where the poles of the movable bridge make contact with the poles on the stationary plate, following which the movable carriage is moved in a direction out of the socket until the movable carriage makes contact with the poles on the stationary plate.

For safe control of the movable carriage it is advantageous if the movable carriage is provided with threads which cooperate with threads on the electrical article, and the stationary plate is provided inside a housing in which the movable carriage and the movable bridge are incorporated.

For further stabilization of the mechanical, movable parts in the touch-safe socket, it is advantageous if the stationary plate is provided with through bores through which legs on the movable carriage and the movable bridge may be moved.

In order to indicate that an electrical connection is established to the electrical article, it is an advantage if a click sound is generated or light is produced in a light-emitting diode which is mounted externally on the housing, at the moment when an electrical connection is established between the poles of the movable carriage and the poles of the electrical article.

This is particularly advantageous if a defective electrical article, such as a bulb, is introduced into the touch-safe socket, as it may then be found out quickly whether the bulb is dead.

The invention will now be explained more fully with reference to the drawings.

DETAILED DESCRIPTION OF THE PREFERRED EMBODIMENT

Figure 1A:
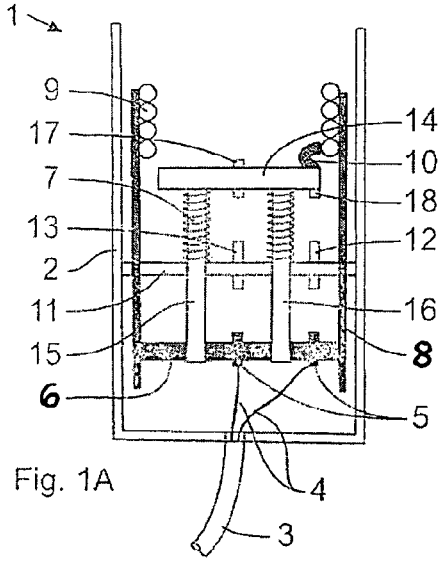
FIGS. 1A-1D show the touch-safe socket according to the invention in various stages, from when an electrical article is introduced into the socket, and until the electrical article is connected to the current-carrying parts of the socket.

In the figures, the numeral 1 generally designates a touch-safe socket according to the invention. It consists of a housing 2 into which, at the bottom thereof, a wire 3 is introduced, having two insulated conductors 4 which are connected to poles 5 on a movable carriage 6. As will be seen, the poles 5 protrude up through a plate part on the carriage 6.

The carriage 6 has a plurality of legs 8, two of which are shown (there are preferably four which are disposed equidistantly on a circle), which extend through a stationary plate 11 secured to the housing 2. At its free upper end the movable carriage has threads 9.

Further, the housing 2 also accommodates a movable bridge 14 having legs 15, 16 which extend through the stationary plate 11. The movable bridge 14 is provided with poles 17, 18 which extend through an upper plate part of the bridge 14.

An annular, movable contact spring 10 is arranged along the edge of the plate part and is movable relative to the threads 9, but so that there is constant contact between the threads 9 and the contact spring 10.

The legs 15, 16 are moreover biased by two springs 7, which are disposed around the legs 15, 16 between the lower side of the upper plate on the movable bridge 14 and the upper side of the stationary plate 11.

Finally, the figures show a bulb 19 which may be an ordinary incandescent bulb or an energy-saving bulb having, e.g., the thread sizes E14, E27, E40.

The threads 20 of the bulb, which also serve as a pole, have another pole which is designated 21.

It will now be explained how the touch-safe socket according to the invention operates.

With reference to FIG. 1A, the touch-safe socket is shown before a bulb 19 is introduced into it.

Figure 1B:
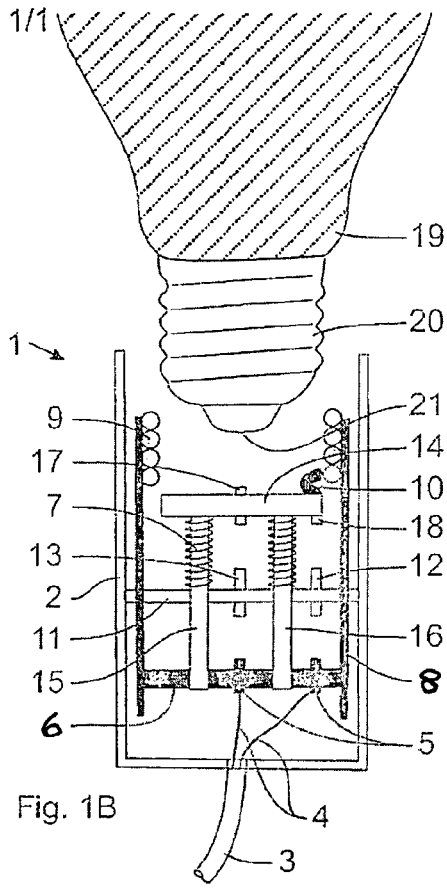

FIG. 1B shows a bulb just before it is inserted into the socket.

Figure 1C:
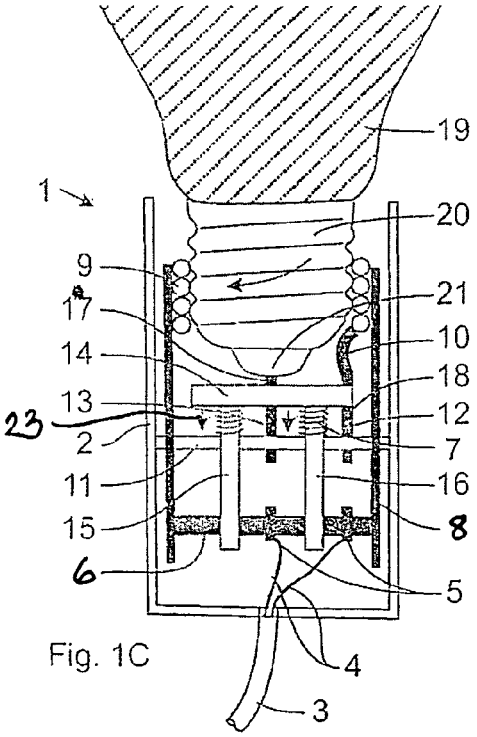
Figure 1D:
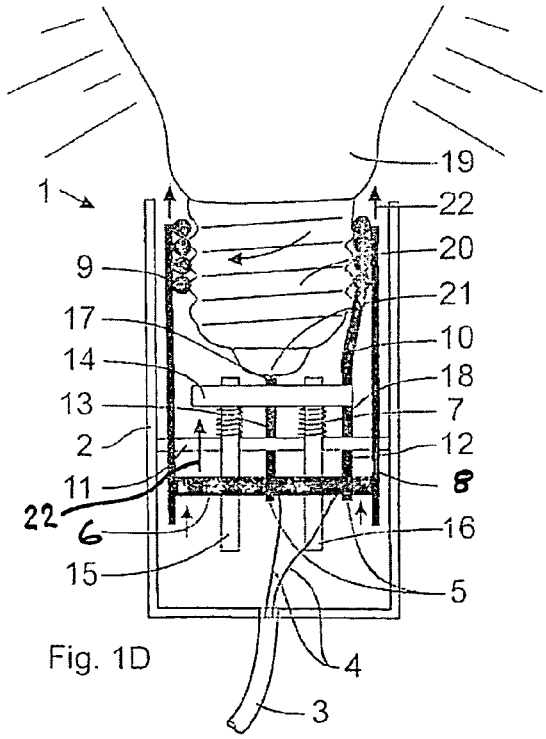

In FIG. 1C, the threads 20 of the bulb have been moved into the threads 9 on the movable carriage 6, but without it having moved as yet.

On the other hand, the movable bridge 14 has moved, which, as will be seen, has been pressed down in the direction of the arrow 23, so that the springs 7 are compressed, thereby making electrical contact between the pole 17 on the movable bridge 14 and the pole 21 on the bulb.

When the bulb 19 is screwed further in, the movable carriage 6 will be pulled up in the direction of the arrow 22, as the movable bridge cannot be pressed further into the touch-safe socket, which causes the threads 9 on the movable carriage 6 to be pulled outwards.

When the bulb has been screwed sufficiently far into the touch-safe socket 1, an electrical connection will be established between the poles 12, 13 on the stationary plate 11 and the poles 5 on the movable carriage 6, following which the bulb receives current and emits light.

Optionally, a mechanical part is arranged in the touch-safe socket, which will emit a click sound when the bulb is connected.

Alternatively, a light-emitting diode, which emits light when current is applied, may also be arranged somewhere on the outer side of the housing 2.

Further, it should be noted that the touch-safe socket also provides some protection if the movable bridge is replaced by a fixed bridge which is located as shown in FIG. 1C

The invention claimed is:

1. A touch-safe socket which socket comprises a housing which provides an opening in which an electrical device can be inserted, a stationary plate mounted in the housing, said stationary plate including a first set of poles, and first and second movable means positioned in the housing on opposite sides of said stationary plate and including respective second and third sets of poles which are aligned with said first set of poles, said first and second movable means moving towards said stationary plates so that said second and third sets of poles contact said first set of poles to convey electrical current to the electrical device when the electrical device is inserted into said housing through said opening.

2. The touch-safe socket according to claim 1, including electrical wires connected to said second set of poles.

3. The touch-safe socket according to claim 1, wherein said first movable means is located on a side of said stationary plate opposite said opening, and including a spring positioned between said second movable means and said stationary plate.

4. The touch-safe socket according to claim 3, wherein said first movable means includes a plate portion which mounts said second set of poles and a plurality of legs which extend past said stationary plate toward said opening.

5. The touch-safe socket according to claim 4, wherein free ends of said plurality of legs define threads for engagement by the electrical device.

6. The touch-safe socket according to claim 4, wherein said second movable means includes a plate portion which mounts said third set of poles, and a plurality of legs that extend through openings in said stationary plate.

7. The touch-safe socket according to claim 6, including a separate spring around each of said plurality of legs of said second movable means between the plate portion thereof and the stationary plate.

8. A touch-safe socket for an electrical device which comprises:

a housing which provides an opening in which the electrical device can be inserted, a stationary plate mounted in the housing, said stationary plate mounting a first set of poles, a movable carriage located in the housing, said movable carriage including a first plate portion on a side of said stationary plate opposite said opening and mounting a second set of poles and a plurality of first legs which extend through openings in the stationary plate and toward said opening, and said plurality of first legs defining threads at free ends thereof near said opening and said second set of poles being aligned with said first set of poles, and a movable bridge located in the housing, said movable bridge including a second plate portion on a side of said stationary plate near said opening and mounting a third set of poles and a plurality of second legs which extend through openings in said stationary plate and toward said first plate, said third set of poles being aligned with said second set of poles, wherein as an electrical device is threaded on the free ends of said first legs, said movable bridge moves toward said stationary plate and said movable carriage moves toward said stationary plate until said first and third sets of poles abut said second set of poles.

9. The touch-safe socket according to claim 8, including springs between said second plate portion and said stationary plate.

* * * * *